US011759072B2

(12) United States Patent
Morphey et al.

(10) Patent No.: US 11,759,072 B2
(45) Date of Patent: Sep. 19, 2023

(54) FLOOR CLEANER

(71) Applicant: Techtronic Cordless GP, Anderson, SC (US)

(72) Inventors: John Morphey, Concord, NC (US); Douglas Rukavina, Concord, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 178 days.

(21) Appl. No.: 17/526,999

(22) Filed: Nov. 15, 2021

(65) Prior Publication Data

US 2022/0071460 A1 Mar. 10, 2022

Related U.S. Application Data

(63) Continuation of application No. 17/083,914, filed on Oct. 29, 2020, now Pat. No. 11,172,800.

(60) Provisional application No. 62/928,686, filed on Oct. 31, 2019.

(51) Int. Cl.
*A47L 9/14* (2006.01)
*A47L 9/32* (2006.01)

(52) U.S. Cl.
CPC ..... *A47L 9/1409* (2013.01); *A47L 9/149* (2013.01); *A47L 9/1463* (2013.01); *A47L 9/325* (2013.01)

(58) Field of Classification Search
CPC ..... A47L 9/1409; A47L 9/1463; A47L 9/149; A47L 9/325
See application file for complete search history.

(56) References Cited

U.S. PATENT DOCUMENTS

| | | | | |
|---|---|---|---|---|
| 2001/0005919 | A1* | 7/2001 | Worden | A47L 7/0042 15/352 |
| 2009/0265883 | A1* | 10/2009 | Reed, Jr. | A47L 9/1608 15/353 |
| 2019/0159646 | A1* | 5/2019 | Luyckx | A47L 7/0004 |
| 2020/0060485 | A1* | 2/2020 | Paulla | A47L 9/325 |
| 2020/0069137 | A1* | 3/2020 | Nguyen | A47L 7/0023 |
| 2021/0068599 | A1* | 3/2021 | Davila | A47L 11/4019 |
| 2021/0127925 | A1* | 5/2021 | Morphey | A47L 9/1463 |

FOREIGN PATENT DOCUMENTS

| | | | |
|---|---|---|---|
| CN | 1568884 | A | 1/2005 |
| CN | 101626716 | A | 1/2010 |
| CN | 101744567 | A | 6/2010 |
| CN | 208677252 | U | 4/2019 |
| CN | 208677275 | U | 4/2019 |

(Continued)

OTHER PUBLICATIONS

Chinese Patent Office Action for Application No. 202080074905.7 dated Nov. 23, 2022 (7 pages including statement of relevance).

(Continued)

*Primary Examiner* — Marc Carlson
(74) *Attorney, Agent, or Firm* — Michael Best & Friedrich LLP

(57) ABSTRACT

A floor cleaner having a recovery tank, a suction source, and a filter basket. The suction source is configured to generate an airflow along a fluid flow path to draw fluid and debris from a surface to be cleaned into the recovery tank. The recovery tank has an outlet duct on a tank body. The filter basket is positioned in the outlet duct on the tank body and configured to filter debris from the airflow.

20 Claims, 8 Drawing Sheets

(56) References Cited

FOREIGN PATENT DOCUMENTS

| | | | | |
|---|---|---|---|---|
| CN | 209269543 | U | 8/2019 | |
| EP | 2359729 | A2 * | 8/2011 | ..... A47L 11/34 |
| EP | 2359729 | A2 | 8/2011 | |
| KR | 20030058054 | A | 7/2003 | |

OTHER PUBLICATIONS

International Search Report and Written Opinion for Application No. PCT/US2020/057918 dated Mar. 4, 2021 (12 pages).

* cited by examiner

FLOOR CLEANER

CROSS-REFERENCE TO RELATED APPLICATIONS

This application is a continuation of U.S. patent application Ser. No. 17/083,914, filed on Oct. 29, 2020, which issued as U.S. Pat. No. 11,172,800 on Nov. 16, 2021, which claims priority to U.S. Provisional Patent Application No. 62/928,686, filed Oct. 31, 2019, the entire contents of which are hereby incorporated by reference herein.

BACKGROUND

The present invention relates to floor cleaners.

SUMMARY

In one embodiment a floor cleaner is disclosed, the floor cleaner including a fluid flow path extending from to a suction nozzle to a clean air outlet, a recovery tank, a suction source, and a filter basket. The recovery tank is removably coupled to the floor cleaner and is in fluid communication with the suction nozzle. The recovery tank includes a tank body, a tank lid removably coupled to the tank body, a tank inlet, a tank air outlet along the fluid flow path, and an outlet duct integral with the tank body upstream of the tank air outlet. The suction source is in fluid communication with the suction nozzle and the recovery tank and is configured to generate an airflow through the fluid flow path to draw fluid and debris from the surface to be cleaned through the suction nozzle and into the recovery tank. The filter basket is positioned in the outlet duct. The filter basket includes a first end, a second end downstream of the first end, and a sidewall extending between the first end and the second end. The first end is open to enable ingress of debris. The sidewall includes perforations to allow air flow to pass through the filter basket and inhibit debris from passing through the basket.

In another embodiment a floor cleaner is disclosed, the floor cleaner including a fluid flow path extending from to a suction nozzle to a clean air outlet, a recovery tank, a suction source, and a filter basket. The recovery tank is removably coupled to the floor cleaner and is in fluid communication with the suction nozzle. The recovery tank includes a tank body, a tank lid removably coupled to the tank body, a tank inlet, a tank air outlet along the fluid flow path, and an outlet duct on the tank body upstream of the tank air outlet. The suction source is in fluid communication with the suction nozzle and the recovery tank and is configured to generate an airflow through the fluid flow path to draw fluid and debris from the surface to be cleaned through the suction nozzle and into the recovery tank. The filter basket is positioned in the outlet duct. The filter basket includes a first end, a second end downstream of the first end, and a sidewall extending in a substantially vertical direction between the first end and the second end when the recovery tank is upright. The first end is above the second end and open to enable ingress of debris. The sidewall includes perforations to allow air flow to pass through the filter basket and inhibit debris from passing through the basket.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
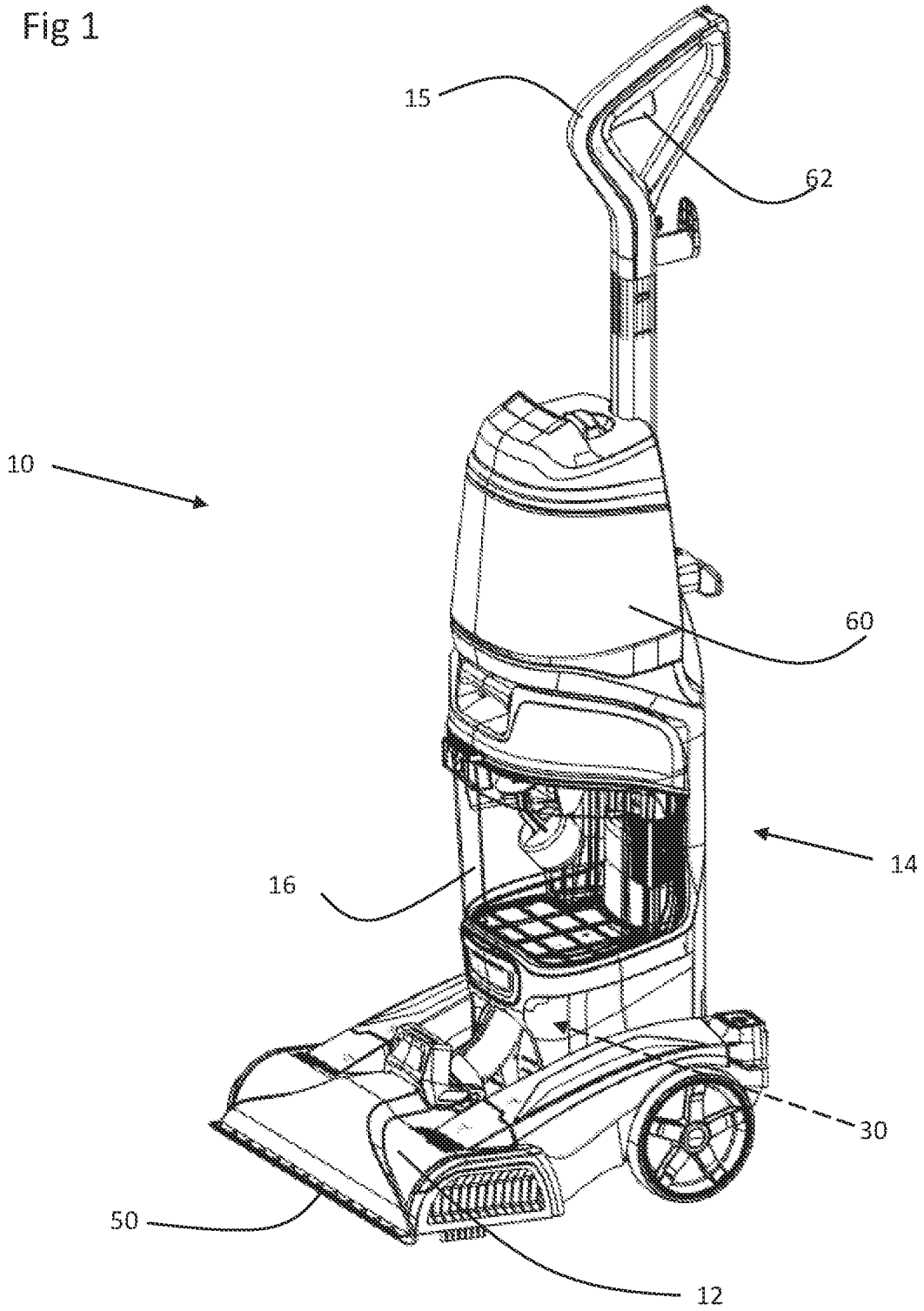
FIG. 1 is a perspective view of a floor cleaner according to one embodiment.

FIG. 1 illustrates a floor cleaner 10. The floor cleaner 10 includes a fluid flow path extending from a suction nozzle 50 to a clean air outlet (not shown). The suction nozzle 50 is positioned on a base portion 12 that is movable along a surface to be cleaned. A recovery tank 16 is removably coupled to the floor cleaner 10, for example to the base 12 or a body portion 14. The recovery tank 16 is in fluid communication with the suction nozzle 50 and a suction source 30. The suction source 30, for example a suction motor (not shown) is configured to generate airflow along the fluid flow path and draw fluid and debris from the surface to be cleaned through the suction nozzle 50 and into the recovery tank 16. The recovery tank 16 includes an air/water separator 48 to separate water and debris from the air flow. The recovery tank 16 further includes a filter basket 32 downstream of the separator 48 to further filter air before discharging the cleaned air through the suction source 30 to the atmosphere. The filter basket 32 includes a sidewall 38 having perforations 40 allowing air flow to pass through the sidewall 38 and inhibiting debris from passing through the filter basket 32.

Figure 4:
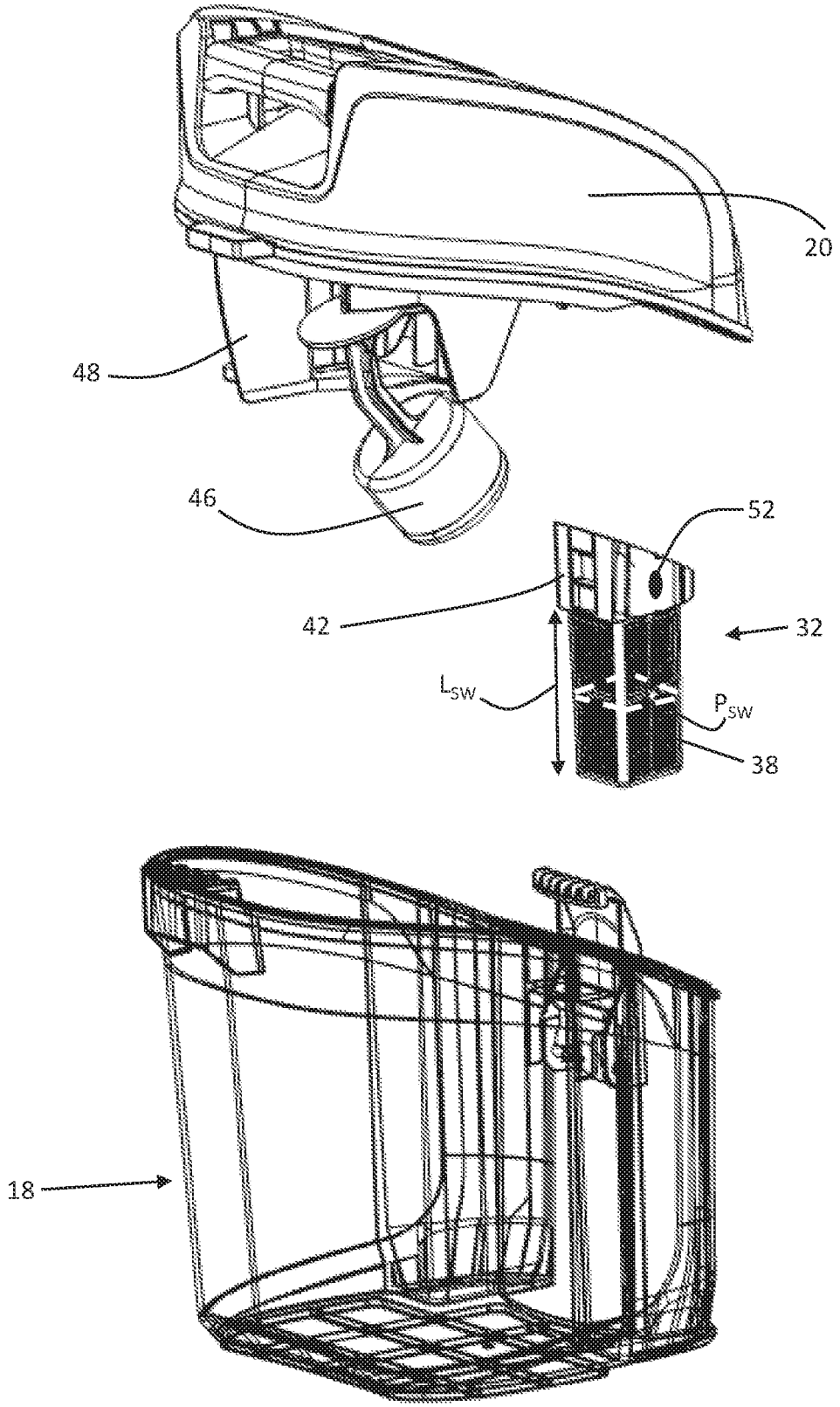
FIG. 4 is an exploded view of the recovery tank of FIG. 2, where a tank lid and a filter basket are shown removed from the tank body.
Figure 5:
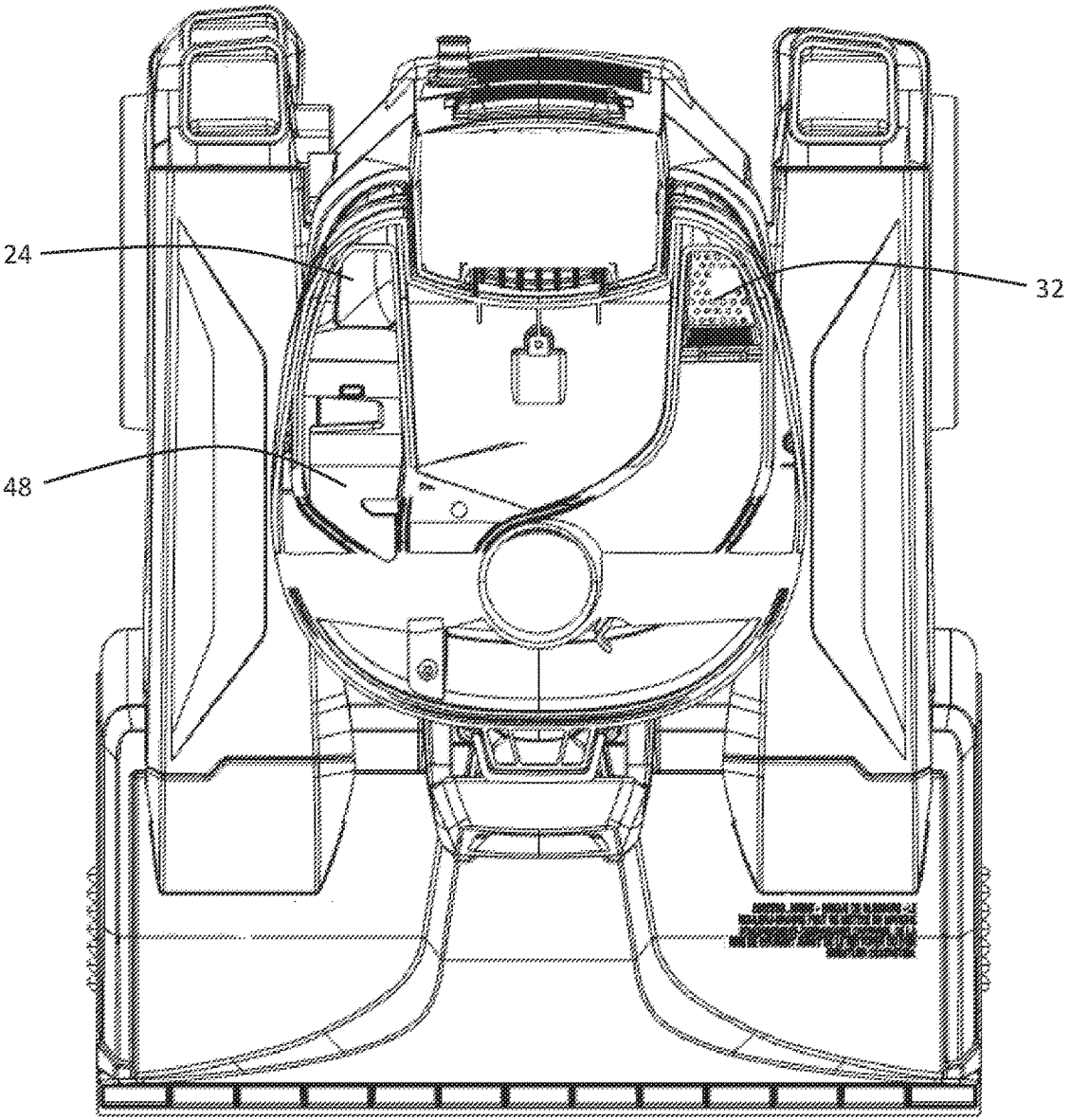
FIG. 5 is a top cross-sectional view of the floor cleaner of FIG. 1.

The recovery tank 16 includes a tank body 18, a tank lid 20 removably coupled to the tank body 18, a tank inlet 24, a tank air outlet 26, and an outlet duct 28 on the tank body 18, upstream of the tank air outlet 26. In one embodiment, the outlet duct 28 is integral with the tank body 18, such as by attaching to or forming with the tank body 18. As illustrated in FIG. 4, the tank lid 20 is removable from the tank body 18 when the recovery tank 16 is in a removed position. The tank lid 20 is removably coupled to the tank body 18 by a securing mechanism, such as a latch. In an open or removed position, the tank lid 20 provides internal access to the tank body 18 and the filter basket 32 for cleaning and maintenance.

Figure 6:
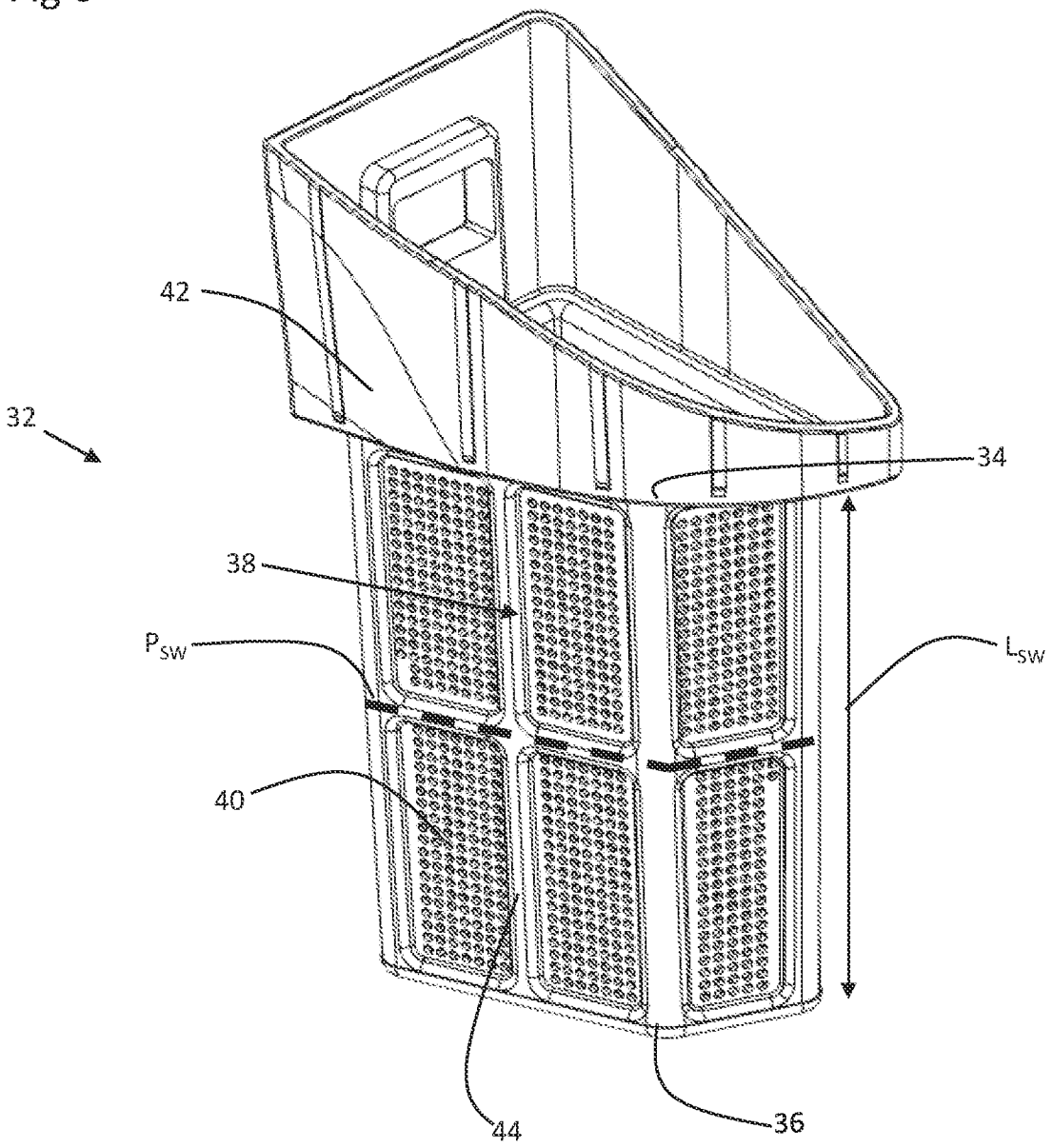
FIG. 6 is a perspective view of the filter basket in a removed position.

In the embodiments shown in FIGS. 1-4, the filter basket 32 is positioned in the outlet duct 28 on the tank body 18. The filter basket 32 includes a first end 34, a second end 36 downstream of the first end, and the sidewall 38 extending between the first end 34 and the second end 36 disposed in the air flow path. In one embodiment, at least a portion of the outlet duct 28 is upright along the tank body 18, and the filter basket 32 extends substantially vertically in the outlet duct 28 when the recovery tank 16 is upright, with the first end 34 being oriented generally above the second end 36. As illustrated in FIG. 6, the first end 34 is open, enabling ingress of debris. The sidewall 38 includes the perforations 40 operably positioned in the outlet duct allowing air flow to pass through the sidewall 38 and inhibiting any remaining debris from passing through the filter basket 32. The resulting clean, filtered air is discharged through the suction source 30 to the atmosphere. In one embodiment, the shape of the sidewall 38 corresponds to at least a portion of the shape of the outlet duct 28. This allows the filter basket 32 to have a desirable basket volume within the outlet duct 28 and an operational air flow through the outlet duct as the basket fills with debris. In one embodiment, a cross-sectional perimeter of the sidewall $P_{SW}$ is between 50% and 95% of a corresponding cross-sectional perimeter of the outlet duct $P_{OD}$, and in one embodiment between about 55% and 80% of cross-sectional perimeter of the outlet duct $P_{OD}$.

The filter basket 32 of the current disclosure with the sidewall 38 extending between the first end 34 and the second end 36 provides greater surface area than a flat filter of the prior art to filter debris from the air flow and increasing the interval between required filter cleaning and/or maintenance. In one embodiment, the second end 36 of the filter basket is perforated to allow further increased surface area for filtration. Because the outlet duct 28 and the filter basket 32 are of corresponding shapes and similar sizes, a length of the sidewall of the filter basket $L_{SW}$ may be extended up to the length of the outlet duct 28 itself, if desired to increase the surface area of the filter basket 32. In this arrangement, increasing the filter basket 32 surface area reduces the filter's impedance of air flow or debris separation.

The length of the perforated portion 40 of the sidewall relative to the cross-sectional perimeter $P_{SW}$ provides surface area of the perforated sidewall 40 to facilitate filtration. In one embodiment, it has been found that filtration efficiency and time between cleaning is increased when the length of the perforated portion of the sidewall $L_{SW}$ from the first end 34 to the second end 36 is greater than 10% of the cross-sectional perimeter $P_{SW}$, and in one embodiment, greater than 25% of the cross-sectional perimeter $P_{SW}$. In one embodiment, the length of the sidewall $L_{SW}$ is approximately equal to or greater than the cross-sectional perimeter of the sidewall $P_{SW}$. In one embodiment, the length of the sidewall $L_{SW}$ is between about 30% and 70% of the cross-sectional perimeter $P_{SW}$. In one embodiment, the length of the sidewall $L_{SW}$ is between about 60% and 95% of the cross-sectional perimeter $P_{SW}$. In one embodiment, the length of the sidewall $L_{SW}$ is between 90% and 125% of the cross-sectional perimeter $P_{SW}$.

Figure 2:
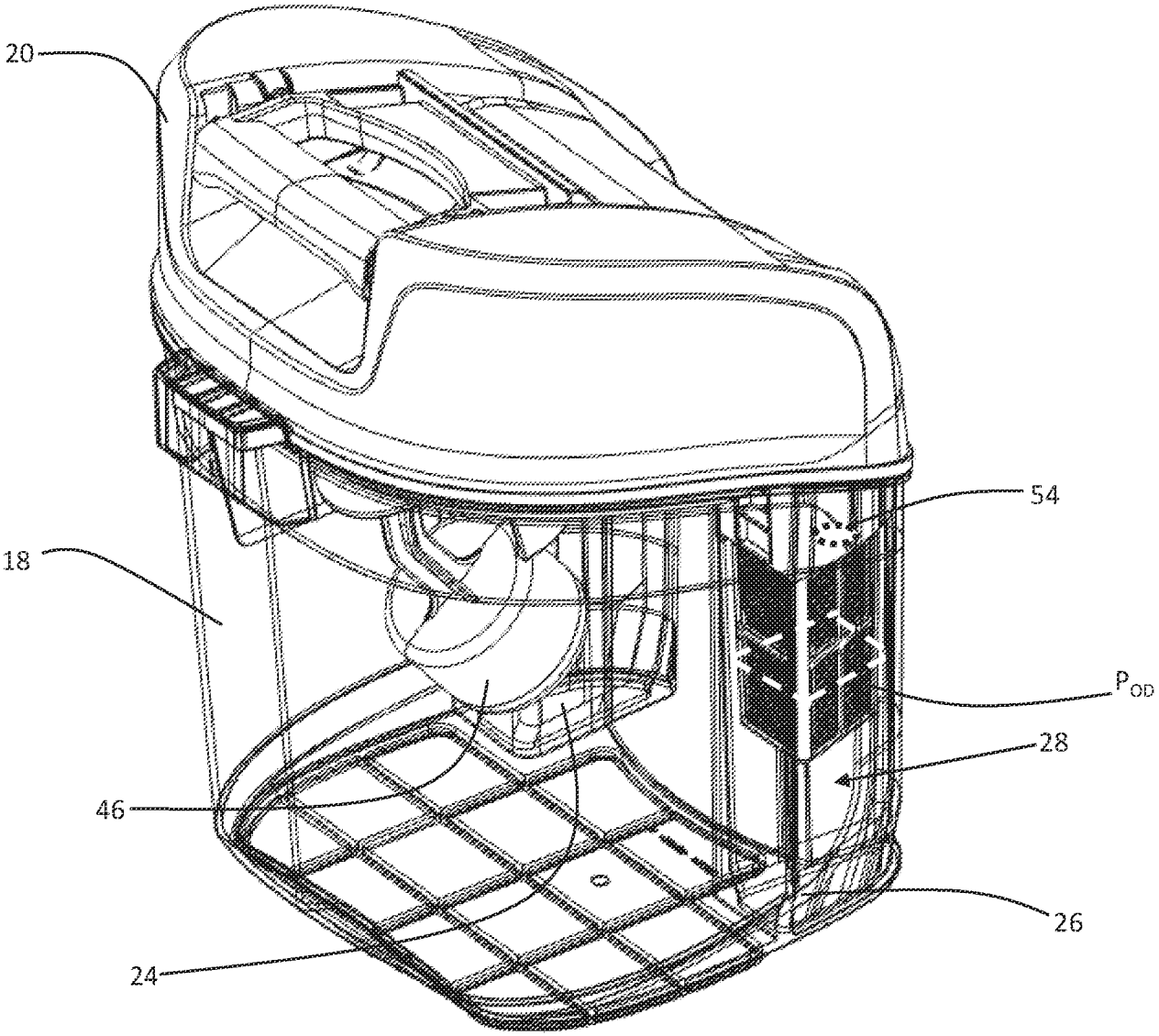
FIG. 2 is a perspective view of a recovery tank of the floor cleaner of FIG. 1 shown having a transparent tank body.

In the illustrated embodiment, the filter basket 32 includes ribs 44 extending between the first end 34 and the second end 36. The ribs 44 provide additional structural support to the filter basket 32. The sidewall 38 includes a solid portion 42 adjacent the first end 34. In one embodiment, the solid portion 42 and the outlet duct 28 are corresponding shapes and similar sizes to inhibit air from passing around the filter basket 32 and directly entering the tank air outlet 26 without being filtered. In one embodiment, the solid portion 42 sealingly engages the outlet duct 28 to further inhibit dirty air flow from bypassing the filter basket 32 without being adequately filtered. As illustrated in FIGS. 2 and 4, the solid portion 42 also may include a first connecting member 52 that corresponds to a second connecting member 54 on the outlet duct 28 to removably couple the filter basket 32 to the outlet duct 28, such as by a protrusion engaging a recess, snap-fit features, T-slot connection, tongue and groove connection, friction fit, or other connecting mechanism. When the tank lid 20 is in an open or removed position, the solid portion 42 may further function as a user-graspable handle or tab. Upon the user grasping the solid portion 42 and providing an upward movement of the filter basket 32, the filter basket 32 is removed from the outlet duct 28 for cleaning or maintenance.

Figure 7:
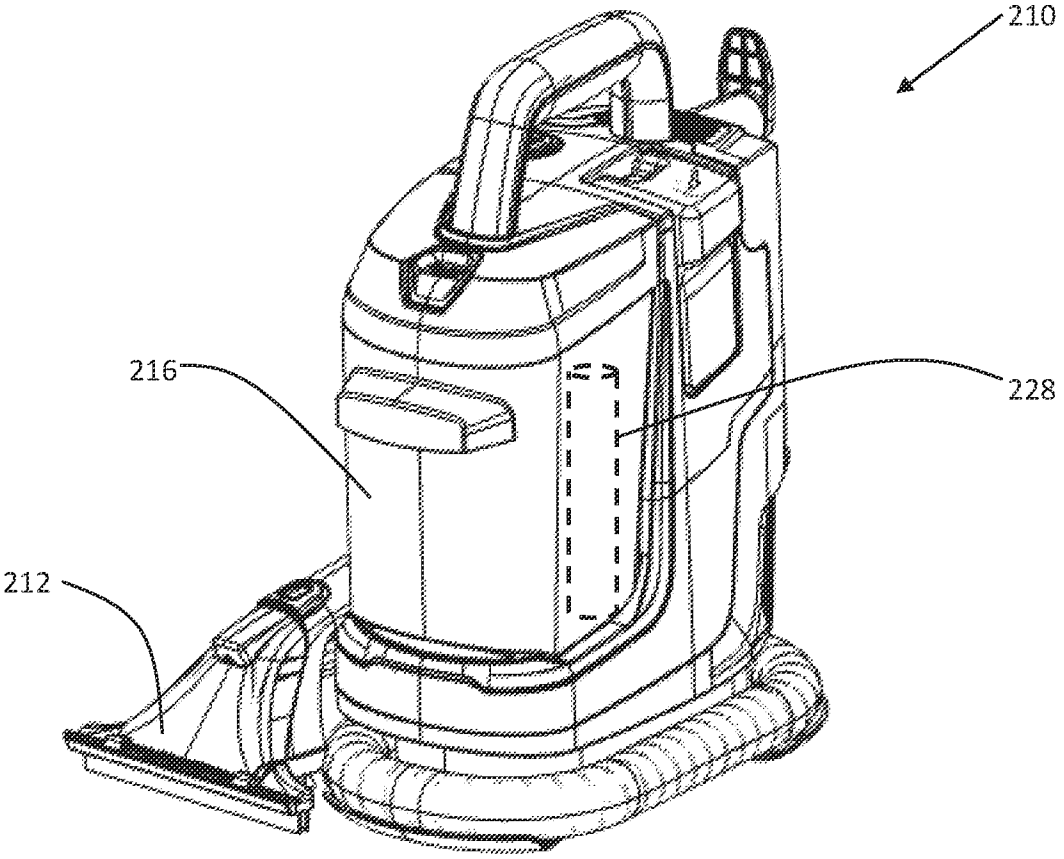
FIG. 7 is a perspective view of an alternate embodiment of a floor cleaner.
Figure 8:
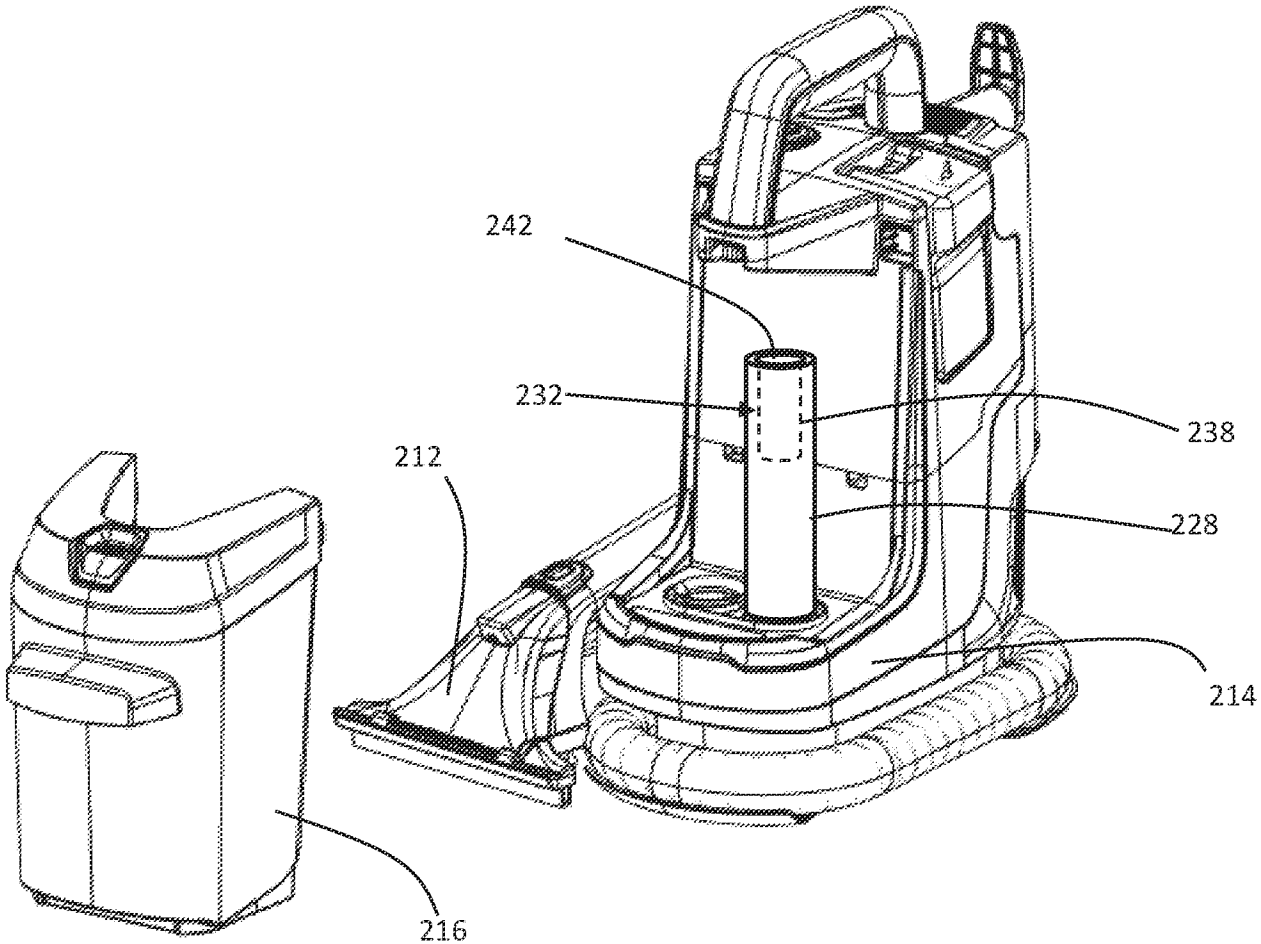
FIG. 8 is an exploded view of the floor cleaner of FIG. 7, where a recovery tank is in a removed position.

In one embodiment, shown in FIGS. 7 and 8, a portable spot cleaner 210 includes a body 214 fluidly coupled with a 220 hose to a hand held suction nozzle 212. An outlet duct 228 and a filter assembly 232 stay with the body 214 of the floor cleaner 210 when the recovery tank 216 is removed. When the recovery tank 216 is in an attached position, the filter assembly 232 is positioned in the outlet duct 228. The recovery tank 216 includes an outlet opening (not shown) operably connected to the outlet duct 228 in the attached position. The filter assembly 232 is configured to engage the outlet opening of the recovery tank 216 in the attached position. The filter assembly 232 includes a sealing portion 242 configured to sealingly engage the opening of the recovery tank 216 in the attached position to prevent air and fluid bypassing the filter assembly 232. The filter basket 232 includes a sidewall 238 having perforations allowing air flow to pass through the sidewall 238 and inhibiting debris from passing through the filter basket 232. When the recovery tank 216 is in the removed position, the exposed filter assembly 232 is then removable from the body 214 for cleaning and replacement. The filter assembly may be removable by lifting the filter assembly away from the floor cleaner. In one embodiment, the filter assembly is removable by a twist-and-lock arrangement, snap-fit engagement, or other similar locking mechanisms. In one embodiment, the filter assembly is attached to the floor cleaner and the recovery tank releases from the floor cleaner leaving the filter attached to the floor cleaner.

Figure 3:
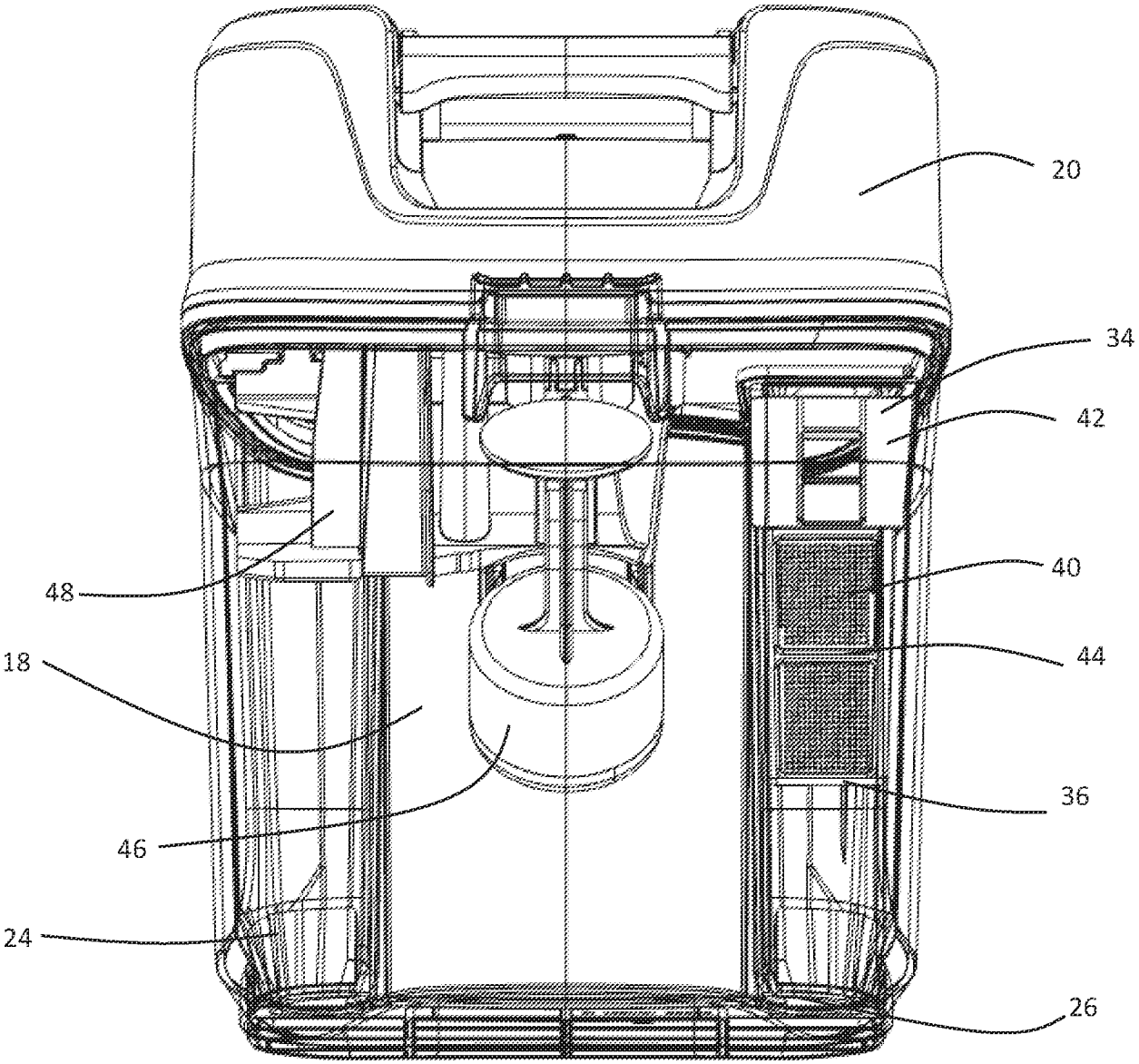
FIG. 3 is a front view of the recovery tank of FIG. 2.

With reference back to the embodiment shown in FIGS. 3 and 4, the tank lid 20 includes the separator 48 downstream of the tank inlet 26 and a shutoff float 46. A mixed (air, fluid, and debris) stream from the suction nozzle 50 enters the tank inlet 26. The stream then contacts the separator 48, where higher-density fluid and debris drop into the tank body 18 and separate from the air stream. Air discharged from the separator 48 has a substantially reduced moisture content, allowing for subsequent filtration and exhaust in other portions of the floor cleaner. The dirty fluid collects in the tank body 18, while the relatively clean air exits the recovery tank 16, through the duct outlet 28 (FIG. 2), and out the tank air outlet 26 (FIG. 3). The shutoff float 46 rises with increasing fluid level in the tank. When the fluid in the recovery tank 16 reaches or exceeds a predetermined level, the shutoff float 46 blocks the fluid flow path, preventing fluid from entering the outlet duct 28.

In the illustrated embodiment, the floor cleaner 10 is an upright extractor operable to clean a surface, such as, for example, a floor. The floor cleaner 10 may be adapted to clean a variety of surfaces, such as carpets, hardwood floors, tiles, or the like. In some embodiments, the floor cleaner 10 distributes or sprays a cleaning fluid (e.g., water, detergent, or a mixture of water and detergent) onto the surface to clean the surface. In one embodiment, the floor cleaner 10 includes a fluid distribution system including a supply tank 60, an actuator 62, and a dispensing nozzle (not shown) in fluid communication with the supply tank 60 to deliver a solution to the surface to be cleaned. The floor cleaner 10 then draws the cleaning fluid and dirt off of the surface through the suction nozzle 50, leaving the surface relatively clean.

The illustrated floor cleaner 10 includes the base 12, the body 14 coupled to the base 12, the body 14 including a handle 15 configured to steer the floor cleaner 10. Other floor cleaners such as non-upright-type extractors or spot cleaners, might include a different base type, such as the portable spot cleaner with a hand suction nozzle 212 shown in FIGS. 7 and 8. In use, the suction source 30 generates an airflow that is drawn through the suction nozzle 50. The airflow and fluid are drawn through the nozzle 50 and through the tank inlet 24 into the recovery tank 16. In the recovery tank 16, the fluid is separated from the airflow by the separator 48, and the airflow is discharged through the outlet duct 28. The filter basket 32 in the outlet duct 28 further filters any debris from the airflow, and the clean air is discharged through the suction source 30 to the atmosphere.

Various features and advantages of the invention are set forth in the following claims.

What is claimed is:

1. A floor cleaner comprising:

a fluid flow path extending from a suction nozzle to a clean air outlet;

a recovery tank in the fluid flow path, the recovery tank in fluid communication with the suction nozzle and including a tank body, a tank inlet, a tank air outlet, and an outlet duct upstream of the tank air outlet;

a suction source in fluid communication with the suction nozzle and the recovery tank, the suction source configured to generate an airflow through the fluid flow path to draw fluid and debris from the surface to be cleaned through the suction nozzle and into the recovery tank; and a filter basket positioned in the outlet duct, the filter basket including a first end, a second end downstream of the first end, and a sidewall extending between the first end and the second end, wherein the first end is open enabling ingress of debris and the sidewall of the filter basket has perforations allowing air flow to pass through the filter basket and inhibiting debris from passing through the filter basket.

2. The floor cleaner of claim 1, wherein the shape of the filter basket sidewall corresponds to at least a portion of the shape of the outlet duct.

3. The floor cleaner of claim 1, wherein a cross-sectional perimeter of the filter basket sidewall is between 50% and 95% of a corresponding cross-sectional perimeter of the outlet duct.

4. The floor cleaner of claim 1, wherein the recovery tank includes a tank lid that is movable between an open position and a closed position, wherein the filter basket is accessible and removable from the outlet duct when the tank lid is in the open position.

5. The floor cleaner of claim 1, wherein the second end of the filter basket has perforations configured to allow air flow to pass through the filter basket and inhibit debris from passing through the filter basket.

6. The floor cleaner of claim 1, wherein a length of the sidewall between the first end and the second end is greater than 10% of a cross-sectional perimeter of the filter basket sidewall.

7. The floor cleaner of claim 1, wherein a length of the sidewall between the first end and the second end is between about 30% and 70% of a cross-sectional perimeter of the filter basket sidewall.

8. The floor cleaner of claim 1, wherein the fluid flow direction through the outlet duct flows downwardly through the filter basket toward the tank air outlet.

9. The floor cleaner of claim 1, wherein the filter basket extends substantially vertically with the first end above the second end when the recovery tank is upright.

10. The floor cleaner of claim 1, wherein the sidewall of the filter basket further includes one or more longitudinal support ribs extending between the first end and the second end.

11. The floor cleaner of claim 1, wherein the sidewall of the filter basket includes a solid portion and a perforated portion, wherein the solid portion is adjacent the first end.

12. The floor cleaner of claim 11, wherein the solid portion sealingly engages the outlet duct.

13. The floor cleaner of claim 11, wherein the solid portion includes a first connecting member that engages a second connecting member on the outlet duct to retain the filter basket in the outlet duct.

14. The floor cleaner of claim 11, wherein the solid portion includes a user-graspable handle portion wherein upward movement of the handle portion removes the filter basket from the outlet duct.

15. The floor cleaner of claim 1, wherein the recovery tank includes a tank lid that is movable between an open position and a closed position, wherein the tank lid includes a separator configured to separate fluid and debris from the airflow upstream of the filter basket.

16. A floor cleaner comprising:

a fluid flow path extending from a suction nozzle to a clean air outlet;

a recovery tank in fluid communication with the suction nozzle and including, a tank body, a tank inlet, a tank air outlet along the fluid flow path, and an outlet duct upstream of the tank air outlet;

a suction source in fluid communication with the suction nozzle and the recovery tank configured to generate an airflow along the fluid flow path to draw fluid and debris from the surface through the suction nozzle and into the recovery tank; and a filter basket disposed in the outlet duct, the filter basket including a first end, a second end being downstream of the first end, and a sidewall extending in a substantially vertical direction between the first end and second end when the recovery tank is upright, wherein the first end is above the second end and the first end is open enabling ingress of debris, and wherein the sidewall of the filter basket has perforations allowing air flow to pass through the filter basket and inhibiting debris from passing through the filter basket.

17. The floor cleaner of claim 16, wherein the shape of the filter basket sidewall corresponds to at least a portion of the shape of the outlet duct.

18. The floor cleaner of claim 16, wherein the second end of the filter basket is closer to the tank air outlet than the first end.

19. The floor cleaner of claim 16, wherein the recovery tank includes a tank lid that is movable between an open position and a closed position, wherein the filter basket is accessible and removable from the outlet duct when the tank lid is in the open position.

20. The floor cleaner of claim 16, wherein the second end of the filter basket has perforations configured to allow air flow to pass through the filter basket and inhibit debris from passing through the filter basket.

* * * * *